United States Patent [19]

Faye

[11] 4,014,074

[45] Mar. 29, 1977

[54] ADJUSTABLE HINGED BRACKET FOR A DRAIN TROUGH

[76] Inventor: Lloyd Henry Faye, 8821 Elm Road, Richmond, Va. 23235

[22] Filed: Feb. 25, 1976

[21] Appl. No.: 661,322

[52] U.S. Cl. ..... 16/135

[51] Int. Cl.[2] ..... E05D 5/06

[58] Field of Search ..... 16/128 R, 135, 137, 16/138, 168, 191

[56] References Cited

UNITED STATES PATENTS 3,098,677 7/1963 Williams ..... 16/128 R X

*Primary Examiner*—G. V. Larkin

*Attorney, Agent, or Firm*—Norman B. Rainer

[57] ABSTRACT

An eaves drain trough is provided which can be manually inverted to facilitate cleaning or servicing. The inverting of the trough is accomplished by means of a hinged bracket comprising an upper harness member pivotably joined to a lower support bracket member. The harness member is constructed so as to enclasp a standard gutter trough in a slideably adjustable manner.

6 Claims, 7 Drawing Figures

ADJUSTABLE HINGED BRACKET FOR A DRAIN TROUGH

BACKGROUND OF THE INVENTION

Most residential-type houses are constructed with pitched roofs. The sloped or angled nature of the roof prevents the accumulation of water, and in many instances minimizes the accumulation of snow. At the lower extremity of a pitched roof, generally referred to as the eaves, there is positioned a drain trough or gutter, the purpose of which is to catch the water which runs off the roof, and channel it to a downspout which leads the water away from the foundation of the house.

In the course of time, such drain gutters tend to accumulated debris such as fallen leaves, which obstruct the gutter and render it ineffective for its intended purpose. Also in the course of time, the gutter, usually of metal construction may require maintenance such as scraping and/or painting. The servicing of such gutters for the purpose of cleaning or painting generally requires the use of a ladder, which makes the task difficult and often perilous.

Although a number of methods have been previously disclosed for simplifying the servicing of eaves-mounted drain gutters, none have been completely successful in operation or sufficiently practical to enjoy any widespread commercial utilization. Mechanically modified gutters have been proposed, such as the one disclosed in U.S. Pat. No. 538,108, issued Apr. 23, 1895, which enable the gutter to be manually tilted or inverted so that its contents will dump out. However, the specific features of such systems generally require the use of costly non-standard, specially constructed gutters. Also, their installation onto the eaves of a house may be so difficult as to render them impractical. This is particularly the case with modern houses wherein the roof overhangs the upper peripheral wooden trim panel of the wall, known as the fascia, by not more than about two inches.

It is an object of this invention to provide a means for simplifying the servicing of a drain gutter mounted at the eaves of a building. It is a still further object to provide a manually invertable drain gutter of simple design utilizing drain gutter of standard design, and permitting easy installation onto the fascia of the building. Other objects and advantages will become apparent from the following description of the invention.

SUMMARY OF THE INVENTION

The objects of the present invention are accomplished in general by providing a uniquely designed hinge comprising an upper harness member pivotably joined to a lower support bracket member.

The harness member is constructed so as to enclasp a standard gutter trough in a slideably adjustable manner. The contour of the harness member is such as to permit the gutter, when seated within the harness member, to fit closely against the fascia of the building, as is the usual manner of installing a standard drain gutter on houses of current design. The underside of the harness member is provided with an aligning blade which imparts strength to the harness member and, when engaged with the lower member, stabilizes the hinge-gutter combination toward lateral displacement.

The lower support bracket is comprised of a horizontal shelf, a vertical mounting surface, and a receiving slot to accommodate the aforementioned aligning blade. Said slot is open at the bottom to prevent accumulation of water and/or debris.

Both upper and lower members of the hinge are joined by a pivot located in front of the hinge and at a level close to the bottom portion of the gutter. The location and function of the pivot is such as to enable the gutter enclasped by the harness member to be swung forward, namely away from the building, and downward to an inverted position. A protective device is provided on the front portion of the hinge to prevent damage to the hinge or gutter when the gutter is swung into the inverted position.

DETAILED DESCRIPTION OF THE INVENTION

Figure 1:
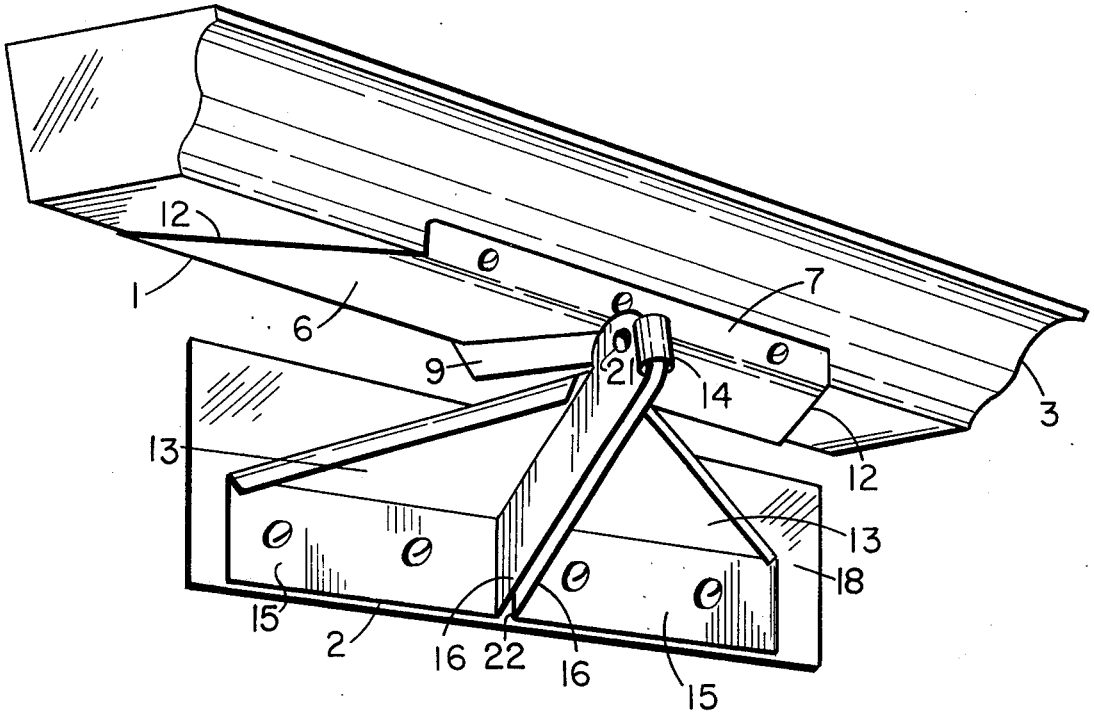
FIG. 1 is a perspective view of a preferred embodiment of the hinge of the present invention in a partially opened condition, viewed from below, showing upper harness member 1, lower support bracket member 2, and a drain gutter 3, positioned within the upper harness member.
Figure 2:
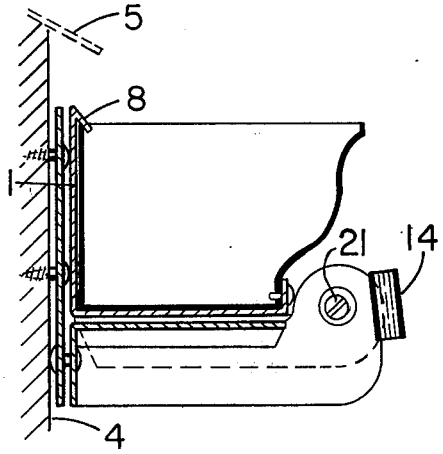
FIG. 2 is an end view of the hinge of FIG. 1 shown in upright position mounted on the fascia 4 and under the edge of the roof 5 of a building.
Figure 3:
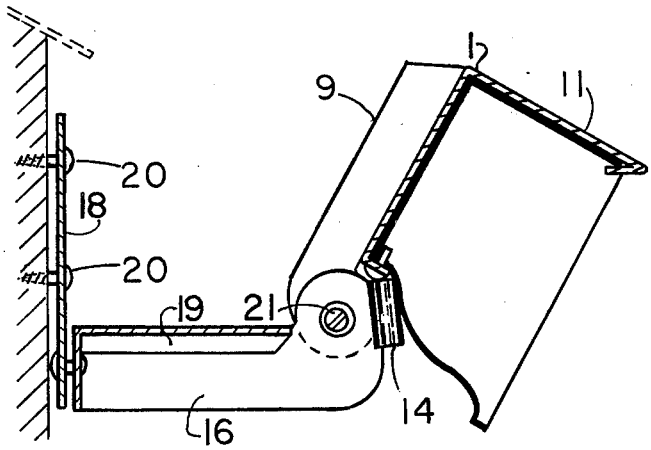
FIG. 3 illustrates the hinge of FIG. 2 in an inverted position.
Figure 4:
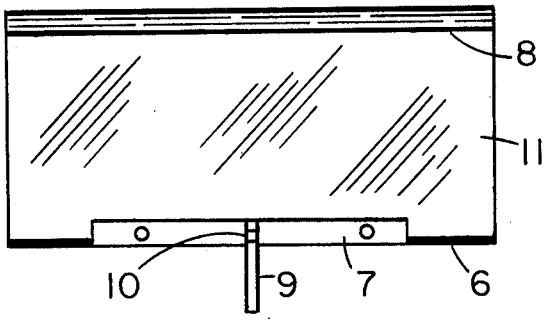
FIG. 4 is a front view of the upper harness member of FIG. 1.
Figure 5:
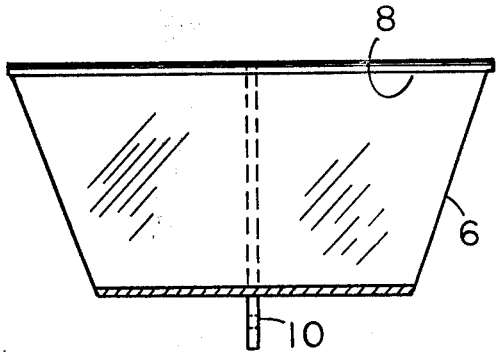
FIG. 5 is a top elevational view of the upper harness member of FIG. 4.

Referring to the accompanying drawings, the harness member 1 shown in FIGS. 1, 2 and 3 is seen to be comprised of a flat seating portion 6, a flat back portion 11 extending vertically above the seating portion, a front retaining lip 7 extending vertically above the seating portion, and a rear retaining lip 8 which extends at a downward angle from the top of the back portion of the harness member.

Although the seating portion of the harness member embodiment of FIG. 1 is shown to have an essentially trapezoidal outline, the open ends 12 of the seating portion can have any reasonable contour in running between the front and rear sides of the harness. Therefore, rectangular shapes are possible, and also shapes wherein the two straight parallel lines representing front and rear sides of the seating portion are connected by curved open ends.

As is more clearly shown in FIG. 3, the harness member 1 also contains, affixed to the underside of the seating portion, an aligning blade 9 which is vertical to both the seating portion and the back portion. The front part of the vertical aligning blade extends in front of and above the seating portion, and contains an aperture 10 to accommodate a pivot pin 21. It should be noted that the seating portion, back portion, and both retaining lips of the harness member are part of an integral structure such as may be formed by an extrusion, roll forming, or bending operation starting with a single flat piece of metal. As is shown in FIGS. 1, 2 and 3, the harness forms a snug fit about the gutter trough. Although, for clarity of illustration, some space is shown between the harness member and the gutter trough in the drawings, in reality a close surface-to-surface contact fit is established. In order for the upper and lower retaining lips to achieve their proper positions about the gutter trough, the harness member must undergo a slight deformation. It is therefore essential that the harness member be of a reasonably flexible or deformable construction. The aligning blade 9 imparts strength and rigidity to the seating portion of the harness member. Therefore, most of the flexibility of the harness member will preferably derive from its back portion.

Once the harness member is snapped onto the gutter trough, it can be slideably positioned along the length of the trough. When the exactly desired location along the length of the trough is found, and particularly after it is joined to the bracket member, the harness can then be permanently fastened to the trough. The manner of fastening the harness member may involve riveting, as shown in FIG. 1, or may involve adhesives, welding, soldering, brazing, or other techniques which will not interfere with the function of the hinge or trough. The harness is preferably constructed of thin, corrosion-resistant metal such as galvanized iron, or aluminum, or weather-resistant plastic such as polyvinylchloride, polyethylene, polypropylene, or rigid polymers or copolymers derived from styrene and acrylonitrile.

As shown in FIGS. 1, 2, 3, 6, and 7, the lower support bracket member of the hinge comprises shelves 13 extending horizontally forward from mounting shoulders 15, and blade guides 16 positioned below the shelf and vertical to both the mounting shoulders 15 and shelves 13. The forward-most portions of the blade guides contain an aperture positioned close to the plane of the shelf, said aperture positioned and designed for acceptance of pivot pin 21 which will engage the hole 10 of the blade of the harness member. Although the shelves depicted in FIG. 7 have a triangular configuration, any reasonable configuration is acceptable.

Figure 6:
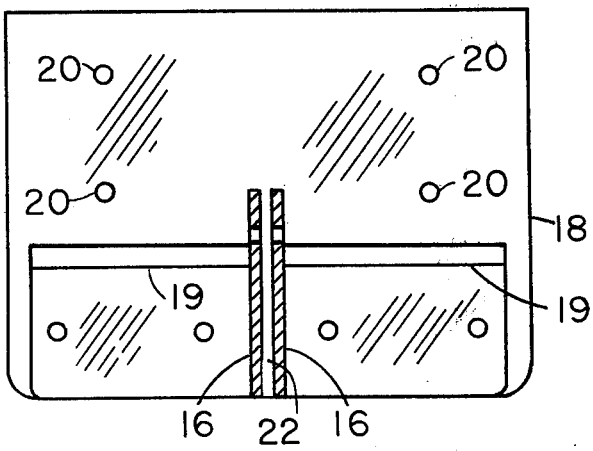
FIG. 6 is a front view of the lower support bracket member of FIG. 1.
Figure 7:
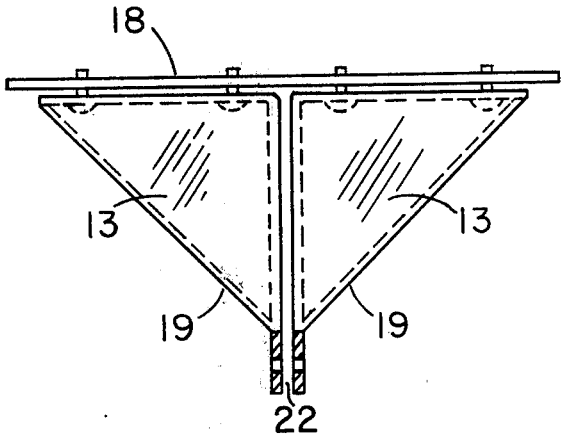
FIG. 7 is a top elevational view of the lower support bracket member of FIG. 6.

The embodiment of the support bracket shown in FIGS. 1, 6 and 7 contains two mirror-image halves which, when positioned closely together as by mounting on a holding plate 18, form an open-bottomed slot 22 between the two facing blade guides. The function of this slot is to accommodate the aligning blade of the upper harness member. In other embodiments however, the open bottomed slot 22 may be formed in different ways.

Each half of the support bracket shown in FIGS. 1, 6 and 7 is an integral structure which can be fabricated from a single flat piece of sheet metal by a stamping, bending, or cutting and forming operation. The blade guides 16 not only form the slot to accommodate the aligning blade, but function as structural supports for the shelves 13. Additional structural support for the shelf may be provided, in preferred embodiments, by downturned lips 19.

When a holding plate 18 is utilized as a part of the support bracket member, it is expedient to design the holding plate to extend above the plane of the shelf to a height comparable to the back portion 11 of the harness member. In this preferred embodiment, mounting of the support bracket member to the fascia of a house is greatly facilitated because nails can be easily hammered through the holding plate and into the wooden fascia.

In the embodiment of the support bracket shown in FIGS. 1, 2, and 3, a protective cushioning pad 14 is positioned on the forwardmost portion of the blade guides in a manner such as to contact the trough when it is in the inverted position, and thereby protect the trough from any damage resulting from repeated inverting of the trough. The presence of the protective pad is not an essential feature of the invention, although it is a preferred embodiment. Although the preferred location of the protective cushioning means is on the protruding aligning blade, other locations and other means for protecting the trough may be utilized.

In installing the hinge of the present invention, the workman will first affix the lower support bracket members to the desired locations in the fascia of the house. This is done most conveniently by driving nails through either the mounting shoulder 15 or, more preferably, the holding plate 18 when it is employed. The upper harness member is then snapped onto the gutter trough in its approximate final position. While the gutter is held in position against the fascia and under the eaves, the position of the harness member is adjusted so that its aligning blade fits into the slot of the already mounted lower bracket member. A pin or rivet is then inserted through the matching holes in the aligning blade and blade guide. This manner of installation is not only simple, but provides precise positioning of the gutter, and can be readily employed with gutter troughs of conventional design. The precise positioning of the gutter affordable by the hinge of the present invention is important because it enables the downspout adapter, a two inch section of tubing attached to the underside of the draining end of the gutter trough, to mate perfectly with the downspout, and to swing freely out of the downspout when the gutter trough is inverted.

In operation, when it is desired to invert the trough, an upward force is exerted, as by means of a long pole, to the rear part of the bottom of the gutter trough. This causes the trough to swing upward and forward, dumping its contents to the ground. In this inverted position, the inside bottom of the trough is visible and accessible to a person standing on the ground below. The trough may then be further cleaned by a stream of water from a hose. Painting may be accomplished by means of a brush mounted on a pole of suitable length. If a step ladder must be utilized in certain situations, the inside bottom of the trough is more readily accessible than would otherwise be the case, and simplifies any servicing chores. Following servicing or inspection of the gutter trough, it can be restored to its normal, upright position merely by applying an upward force to the front upper edge of the trough.

Because the hinge of the present invention permits inversion of the trough by means of an upward force, there is no undue downward stress exerted on the bottom support bracket member. This is an important advantage because it permits the hinge to have adequate strength without resort to expensive and cumbersome structural reinforcement. Another significant advantage of the hinge of this invention is that most of it is concealed by the gutter trough, and it therefore does not detract from the appearance of the house. A still further advantage is that, whereas gutters are ordinarily mounted on the fascia of buildings by means of large diameter spikes driven through the top of the gutter, said spikes frequently causing splitting of the wooden fascia, the mounting of gutters using the hinge of this invention is accomplished through the use of relatively small nails 20, as shown in FIGS. 2, 3 and 6.

In some gutter trough installations utilizing the hinge of the present invention, it may be found desirable to install reinforcing struts across the top of the trough, extending between front and rear top edges. The purpose of the reinforcing struts is to prevent outward bulging or warping of the trough by virtue of the weight of water, snow, ice, or debris which may accumulate, particularly in unattended troughs. At inside corners of the roof, each of the converging trough sections is terminated with an end plate, permitting a separation of the trough sections sufficient to provide clearance when either section is inverted. A deflector plate mounted on the roof directs water into each of the trough sections. On outside corners of the roof, each of the two converging trough sections is terminated with an end plate mitered to a 45° angle on the trough.

I claim:

1. A hinge comprising a harness member comprising a seating portion, a flexible back portion, a front retaining lip extending substantially vertically above said seating portion, a rear retaining lip extending at a downward angle from the top of said back portion, and an aligning blade affixed to the underside of said seating portion and vertically positioned with respect to said seating portion and said back portion, and a support bracket member comprising a shelf extending horizontally forward, a mounting shoulder disposed perpendicularly to said shelf, and an open-bottomed slot located beneath said shelf and adapted to receive the aligning blade of said harness member, said harness member being pivotably joined to said support bracket member.

2. The hinge of claim 1 wherein the seating portion, back portion, front retaining lip and rear retaining lip of said harness member constitute a single integral shaped structure.

3. The hinge of claim 1 containing protective cushioning means affixed to said harness member or support bracket member.

4. The hinge of claim 1 wherein said harness member is pivotably joined to said support bracket member by means of a pivot pin engaging said members at forward portions thereof.

5. A hinge comprising a harness member comprising a seating portion, a flexible back portion, a front retaining lip extending substantially vertically above said seating portion, a rear retaining lip extending at a downward angle from the top of said back portion, and an aligning blade affixed to the underside of said seating portion and vertically positioned with respect to said seating portion and said back portion, and a support bracket member comprised of two minor-image members, each comprised of a horizontal shelf, a mounting shoulder disposed perpendicularly to said shelf, and a blade guide positioned below said shelf, said two mirror image members being fastened by their mounting shoulders to a holding plate and positioned so that said blade guides face one another, forming an open-bottomed slot therebetween, said slot adapted to receive the aligning blade of said harness member, said harness member being pivotably joined to said support bracket member.

6. In combination, the hinge of claim 1 containing, within the harness member thereof, a drain trough.

* * * * *